United States Patent [19]

O'Brien

[11] Patent Number: 4,999,973

[45] Date of Patent: Mar. 19, 1991

[54] SHEET MATERIAL ADVANCER

[76] Inventor: Donald J. O'Brien, 3302 Harlan Lewis Rd., Bellevue, Nebr. 68005

[21] Appl. No.: 442,053

[22] Filed: Nov. 28, 1989

[51] Int. Cl.[5] ..... B65B 61/02

[52] U.S. Cl. ..... 53/411; 53/131.2; 493/188; 493/325

[58] Field of Search ..... 53/131, 202, 411, 290, 53/282, 281; 493/188, 187, 325, 324, 321

[56] References Cited

U.S. PATENT DOCUMENTS

| | | | |
|---|---|---|---|
| 1,714,265 | 5/1929 | Gurwick | 53/131 X |
| 2,858,131 | 10/1958 | Leshner | 271/2.4 |
| 3,515,327 | 6/1970 | Bortmas | 226/113 |
| 3,662,511 | 5/1972 | Eliasberg | 53/131 X |
| 4,033,092 | 7/1977 | Vetter | 53/131 X |
| 4,739,604 | 4/1988 | Natterer | 53/131 |
| 4,753,059 | 6/1988 | Natterer | 53/131 |

*Primary Examiner*—James F. Coan

*Attorney, Agent, or Firm*—Zarley, McKee, Thomte, Voorhees & Sease

[57] ABSTRACT

A sheet material advancer includes a base frame with a pair of spaced-apart end plates projecting from the frame. A first cylinder is mounted between the end plates and will redirect a sheet of material from a generally vertical position to a horizontal orientation. A reciprocating cylinder is operably mounted on the base frame parallel to the first cylinder and is operable between a home position adjacent the first cylinder and an extended position spaced a predetermined distance from the first cylinder. The sheet material extends from the first cylinder around the second cylinder and then to an uptake. Pneumatic cylinders are mounted on the base frame and connected to the reciprocating cylinder so as to selectively move the reciprocating cylinder between the home and extended positions.

3 Claims, 4 Drawing Sheets

SHEET MATERIAL ADVANCER

TECHNICAL FIELD

The present invention relates generally to devices for advancing sheet material, and more particularly to sheet material advancers utilized in conjunction with printing apparatus which is reciprocated across the sheet material for printing data thereon.

BACKGROUND OF THE INVENTION

Ink jet printers are well known in the art, and are advantageously utilized in plants utilizing mass production techniques. In particular, ink jet printers are beneficial for applying visible information on packaging of a type formed in continuous sheets which are moved past the printer. The apparatus therefore may be utilized to apply code dates, company names and addresses, or other data to various packaging material.

In sausage packaging equipment, a continuous sheet of labels is threaded through the packaging machine, imprinted with the appropriate data, and then die pressed against an open-topped container carrying the product so as to seal the product therein. In such packaging equipment, it is common to utilize a die which extends across two full rows of containers, so as to reduce the number of movements necessary to attach labels thereto.

However, a problem arises in those situations where a die utilized which will affix more than a single row of labels to the corresponding packages. This problem occurs in the printing apparatus, which is designed to print a single transverse row of labels in a single horizontal pass. Thus, it is necessary to either (1) move the printing apparatus vertically to the next row of labels to imprint the appropriate data; or (2) advance the sheet material so as to align the next row of labels with the printer apparatus. Without these two alternatives, the packaging apparatus would be forced to use only a single row die, or to utilize printing apparatus which prints in vertical columns rather than in horizontal rows.

It is therefore a general object of the present invention to provide an improved sheet material advancer for a packaging machine.

Another object of the present invention is to provide a sheet material advancer which will allow the use of a transversely movable printer in combination with a continuous sheet of vertical columns of labels.

A further object of the present invention is to provide a sheet material advancer which permits the use of dual row or greater die press apparatus in combination with a transversely movable printer apparatus.

Yet another object of the present invention is to provide a sheet material advancer which is simple to operate, and economical to manufacture.

These and other objects of the present invention will be apparent to those skilled in the art.

SUMMARY OF THE INVENTION

The sheet material advancer of the present invention includes a base frame with a pair of spaced-apart end plates projecting from the frame. A first cylinder is mounted between the end plates and will redirect a sheet of material from a generally vertical position to a horizontal orientation. A reciprocating cylinder is operably mounted on the base frame parallel to the first cylinder and is operable between a home position adjacent the first cylinder and an extended position spaced a predetermined distance from the first cylinder. The sheet material extends from the first cylinder around the second cylinder and then to an uptake. Means are mounted on the base frame and connected to the reciprocating cylinder so as to move the reciprocating cylinder between the home and extended positions upon selective activation.

Preferably, the sheet material advancer is mounted on a packaging apparatus or the like of the type utilizing a continuous sheet of labels formed from transverse rows and longitudinal columns of labels. A printer apparatus mounted on the frame is adapted to print data on each row of labels. A die means is operably mounted on the frame to seal at least two rows of labels with two rows of containers during a single operating cycle. The uptake will draw the continuous sheet of containers and labels through the packaging apparatus. The sheet material advancer will advance the continuous sheet of labels one row, so as to align the next adjacent row of labels with the printer, without requiring the uptake to draw the labels through the packaging apparatus.

DESCRIPTION OF THE PREFERRED EMBODIMENT

Figure 1:
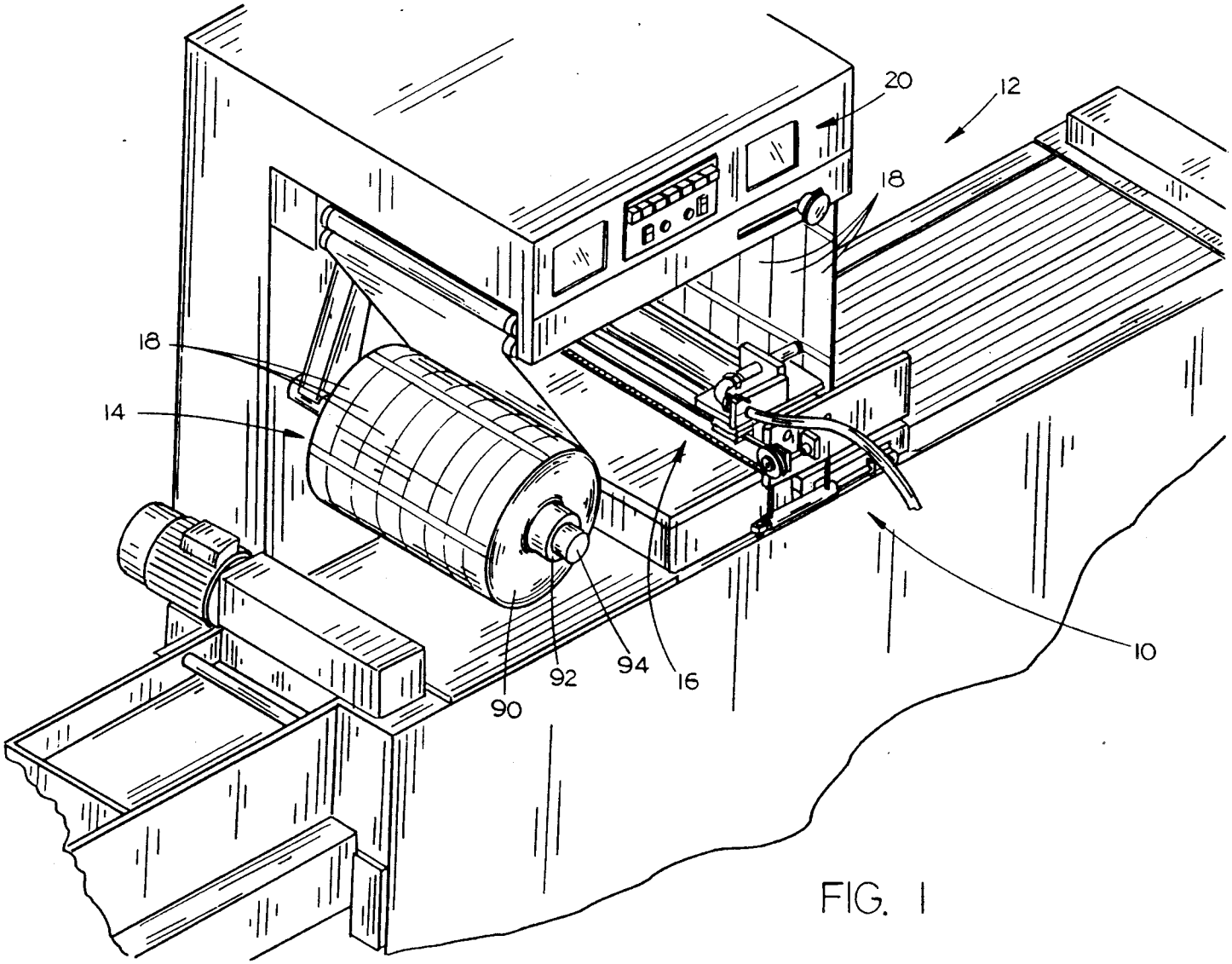
FIG. 1 is a perspective view of a packaging apparatus utilizing the sheet advancer of the present invention.

Referring now to the drawings, in which identical or corresponding parts are identified with the same reference numeral, and more particularly to FIG. 1, the sheet material advancer of the present invention is identified generally at 10 and is mounted on a packaging apparatus 12 having a roll of continuous sheet material labels 14 operably mounted thereon upon which data will be printed. A transversely operable printer apparatus is identified generally at 16 which moves horizontally so as to imprint data along a single row of labels 18 of sheet material 14. A control apparatus, designated generally at 20, is contained within the housing of the packaging machine 12. In some cases, control apparatus 20 may be housed separately from the packaging machine 12, but interconnected so as to control the functioning of the entire unit.

Figure 2:
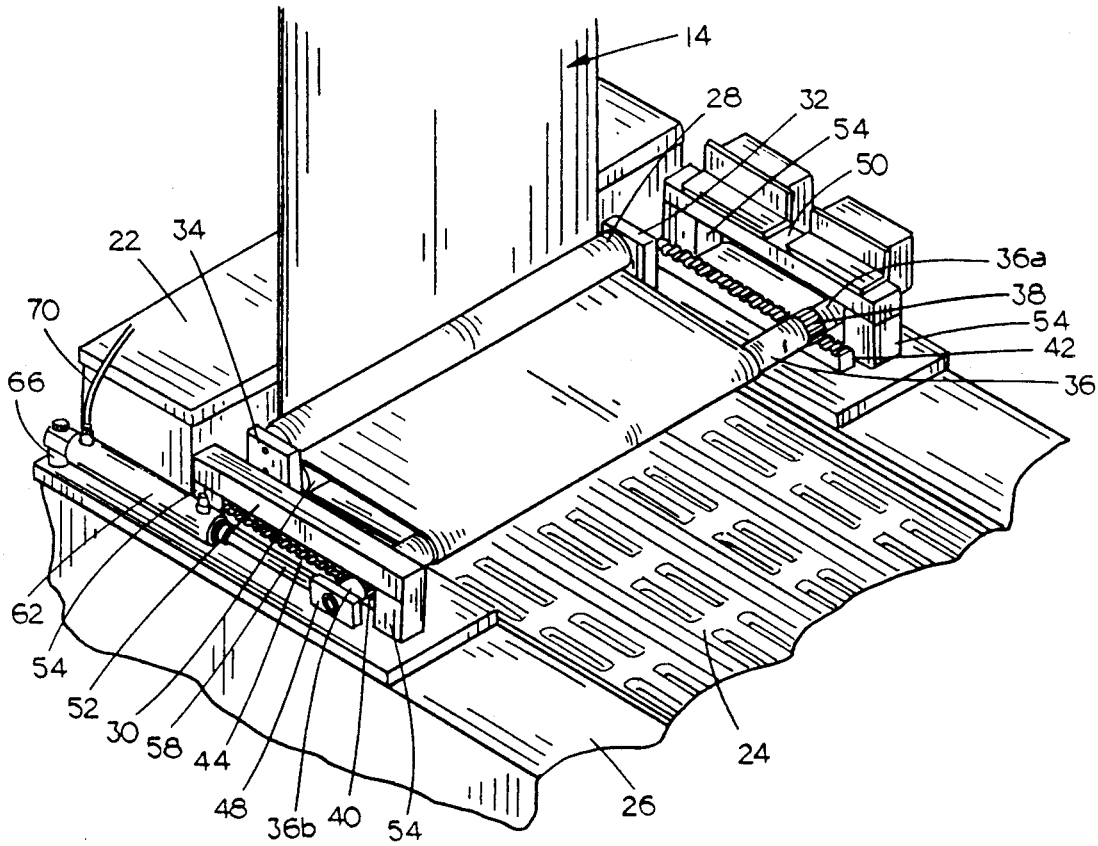
FIG. 2 is an enlarged perspective view of a portion of the packaging apparatus of FIG. 1, taken from the right side of FIG. 1, and more clearly showing the sheet material advancer of the present invention.
Figure 5:
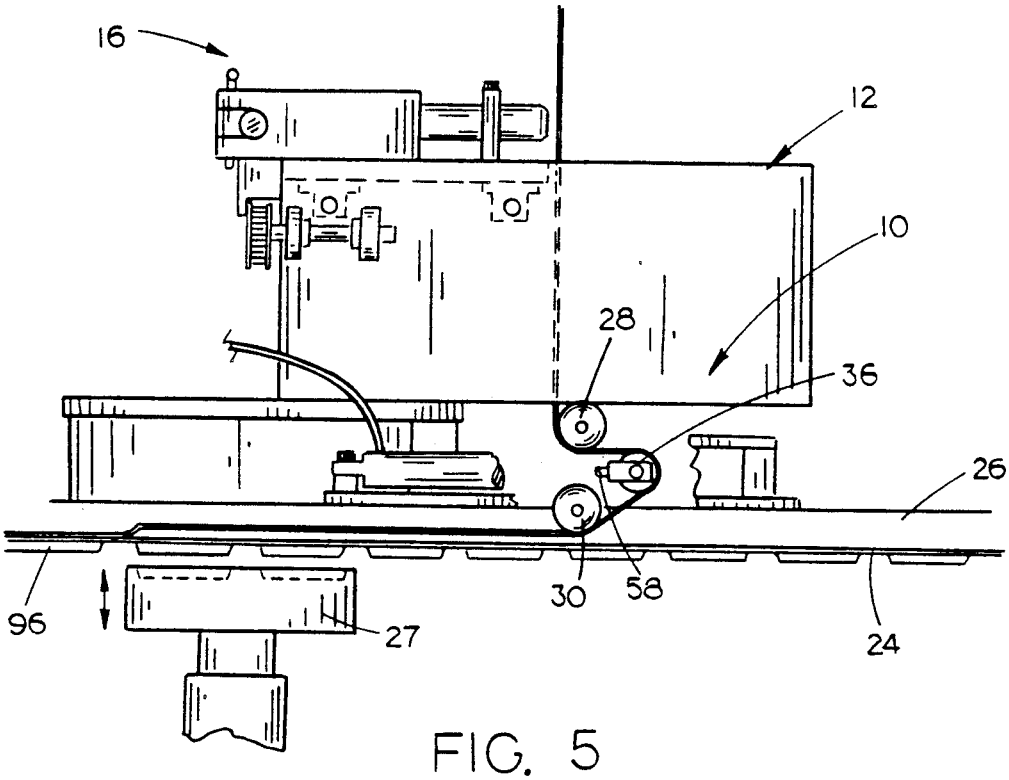
FIG. 5 is an elevational view with portions shown in section taken from the left side of FIG. 2, and showing the die apparatus in schematic form.
Figure 6:
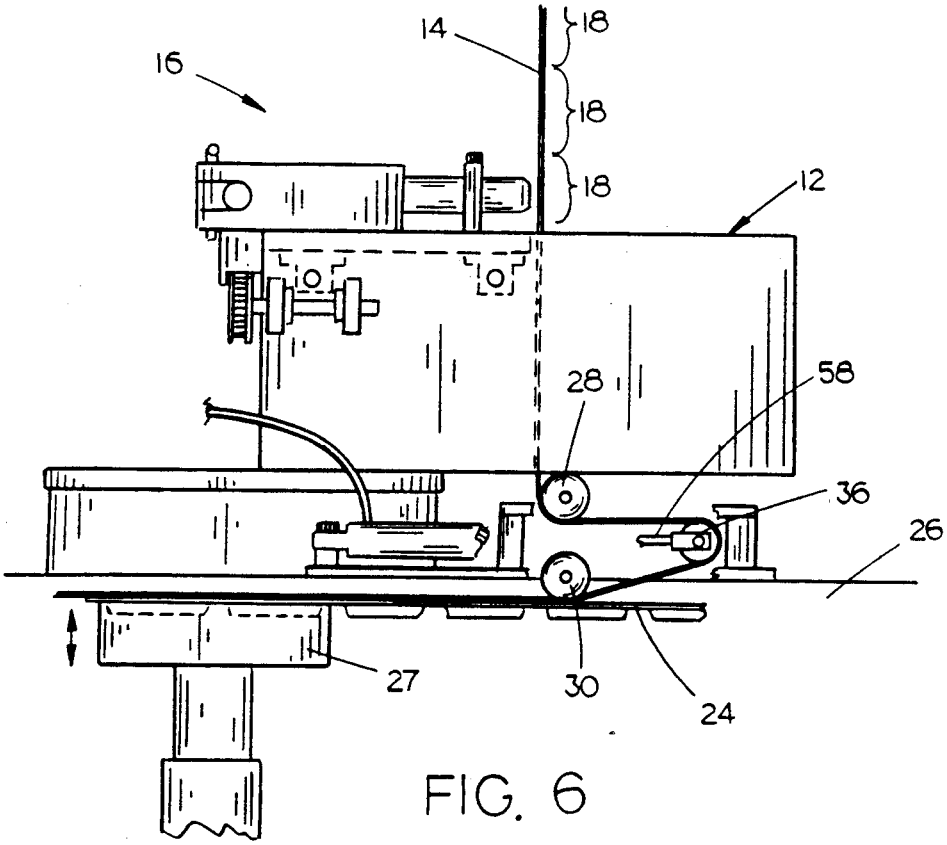
FIG. 6 is a view similar to FIG. 5, but showing the invention in a second position.

Referring now to FIG. 2, sheet material 14 extends generally vertically downward past a printer table 22 which supports printing apparatus 16 (see FIG. 5). Conventionally, this sheet material would extend directly down adjacent the sheet of containers 24 moving along container support table 26 and then advance towards a die (shown in FIG. 5) 27 which will compress sheet material 14 against container sheet 24 so as to seal them together to form individual packages. In the present invention, the sheet material advancer 10 is interposed adjacent container sheet 24, as shown in FIGS. 2, 5 and 6.

Sheet material advancer 10 includes a pair of cylinders 28 and 30 rotatably mounted between a pair of upstanding end plates 32 and 34, such that upper cylinder 28 is parallel and spaced vertically above lower cylinder 30. A third reciprocating cylinder 36 is mounted so as to reciprocate along a horizontal plane intermediate cylinders 28 and 30, and forward and away from cylinders 28 and 30, as described in more detail hereinbelow.

Reciprocating cylinder 36 has a pinion 38 and 40 mounted on each end which intermeshes with racks 42 and 44 mounted on the upper surface of container support table 26. Ends 36*a* and 36*b* of reciprocating cylinder 36 extend beyond pinions 38 and 40 and are rotatably mounted in bearings 46 and 48. Cylinder ends 36*a* and 36*b* are restrained from upward vertical movement by horizontally oriented bars 46 and 48 respectively. Bars 46 and 48 are mounted on feet 50, as shown in FIG. 2.

Bearings 46 and 48, which support reciprocating cylinder 36, are each mounted on the end of extension rods 56 and 58, respectively, operably mounted in dual action cylinders 60 and 62 respectively. The base end 60*a* and 62*a* of each cylinder 60 and 62 is mounted to the top surface of container support table 26 via bolts 64 and 66 respectively. A fluid conduit 68 is operably connected to cylinder 60, to supply fluid thereto so as to extend rod 56. A similar fluid conduit 70 is operably mounted on cylinder 62.

Figure 3:
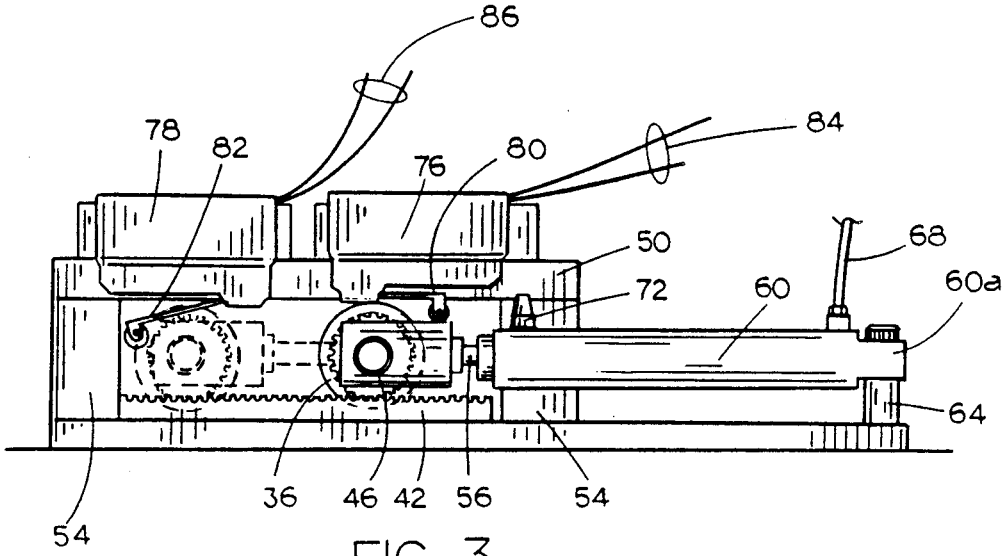
FIG. 3 is a side elevational view taken from the right side of FIG. 2.

Referring now to FIG. 3, a pair of mechanically activated switches 76 and 78 are mounted on bar 50 and have their movable contacts 80 and 82, respectively, mounted for movement within a vertical plane. As shown in FIG. 3, contacts 80 and 82 are mounted in alignment with bearing 46, such that rearward movement of bearing 46 to the solid line position shown in FIG. 3 will raise contact 80 and open switch 76. At the same time, contact 82 would be in a lower position such that switch 78 is closed. Movement of bearing 46 to the forward position, shown in broken lines, would raise contact 82 and open switch 78. Electrical wires 84 extend from switch 76 to control apparatus 20, so as to signal the open or closed condition of switch 76. Similarly, electric wires 86 extend from switch 78 so as to signal the open or closed position of that switch.

Figure 4:
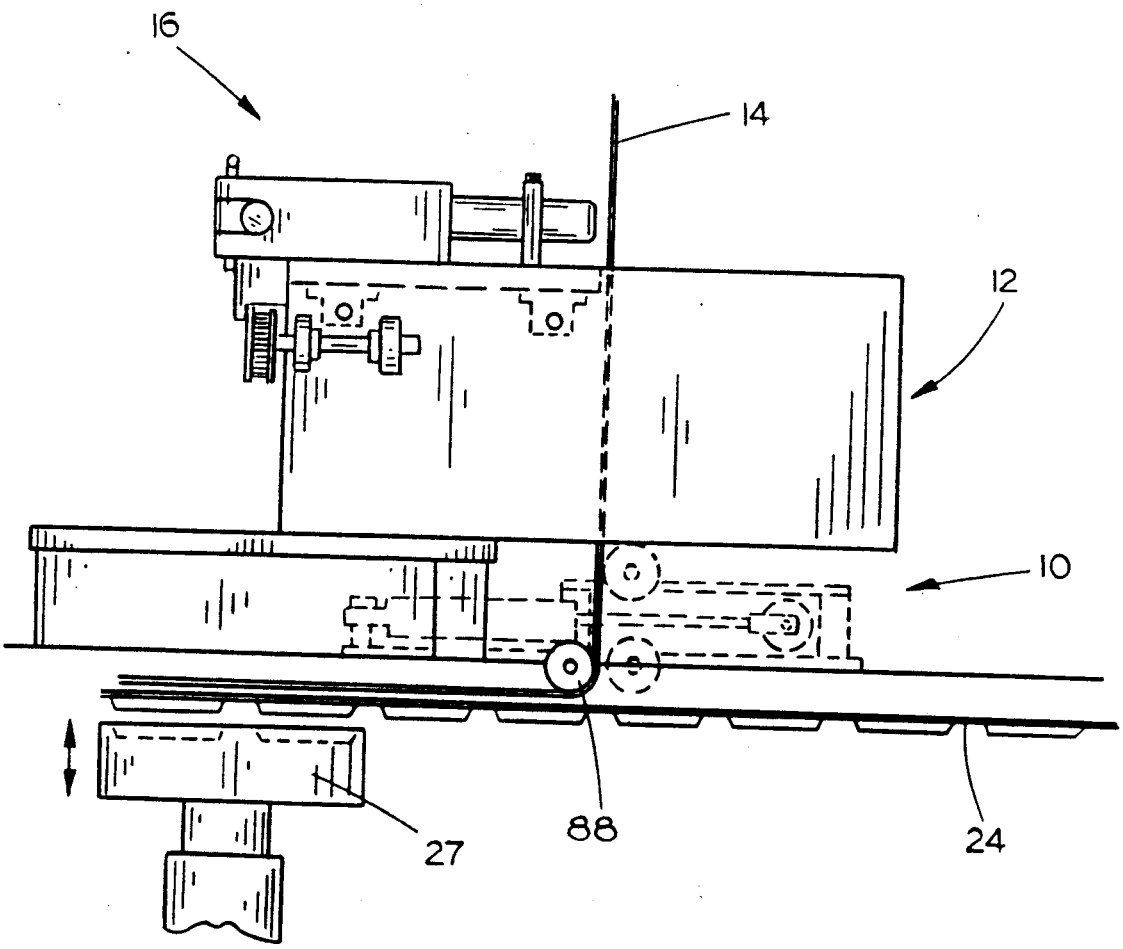
FIG. 4 is a side elevational view taken from the right side of FIGS. 2, but showing an unmodified packaging apparatus with the present invention shown in broken lines.

A conventional packaging apparatus 12 may be simply modified so as to add the sheet material advancer 10 of the present invention. In the unmodified form, sheet material 14 extends vertically downwardly past printer apparatus 16 and thence around a rotatable cylinder 88 before continuing to operable die 27. FIG. 4 shows the sheet material advancer 10 in broken lines, and located in the appropriate position on packaging apparatus 12. To modify packaging apparatus 12, cylinder 88 is removed, and the sheet material advancing apparatus 10 is mounted on container support table 26, as shown in FIGS. 2–3 and 5–6. Sheet material 14 is then positioned to extend around upper cylinder 28, thence horizontally around reciprocating cylinder 36, and then under lower cylinder 30 toward die 27.

In operation, reciprocating cylinder 36 is operable between a "home" position with extensible cylinder rods 56 and 58 in the retracted position, as shown in FIG. 5, and an "extended" position with extensible rods 56 and 58 extended, as shown in FIG. 6. The distance which reciprocating cylinder moves between the "home" and "extended" positions is equal to one-half the length of a label 18, such that operation of the reciprocating cylinder 36 will advance sheet material 14 one label length 18.

Once printer apparatus 16 has printed the desired information along one horizontal row of labels 18, dual action cylinders 60 and 62 are operated by control apparatus 20 so as to extend extensible rods 56 and 58 thereby moving reciprocating cylinder 36 to the "extended" position shown in FIG. 6. During this time period, die 27 is in the upper position compressing container sheet 24 and sheet material 14 together, so that extension of reciprocating cylinder 36 will cause sheet material to advance one label length 18 past printer apparatus 16. Movement of reciprocating cylinder 36 is halted once contact 82 is moved upwardly by bearing 46 so as to open switch 78. The use of pinions 38 and 40 on cylinder 36, in combination with racks 42 and 44, maintains cylinder 36 parallel relation to cylinders 28 and 30. This in turn causes sheet material 14 to be advanced uniformly to align the next set of horizontal labels 18 directly in front of printing apparatus 16.

The opening of switch 78 signals control apparatus 20 to signal printing apparatus 16. Once printing apparatus 16 has printed an additional row of labels 18, control apparatus 20 will signal die 27 to return to a lower position (as shown in FIG. 5), and deactivate cylinders 60 and 62. Packaging apparatus 12 can then advance container sheet 24 two label lengths to align the next set of labels and containers over die 27. Advancement of container and label sheets 24 and 14 will thereby "pull" cylinder 36 into its "home" position.

Sheet material 14 extends from a roll 90 (shown in FIG. 1) which is operably mounted on a bearing 92 designed to frictionally engage a shaft 94 to provide constant tension on sheet material 14. Thus, as sealed packages 96 are drawn from packaging apparatus 12 (see FIG. 5), reciprocating cylinder 36 is drawn back to its "home" position by the movement of sheet material 14 across die 27. Tension on sheet material roll 90 prevents movement of roll 90 during the retraction of cylinder 36. Once extensible rods 56 and 58 have been retracted, electrical contact 80 is moved by bearing 46 so as to open switch 76 and thereby provide a signal to control apparatus 20. This signal once again operates die 27 to seal the next pair of rows of containers to their corresponding labels, and signals printing apparatus 16 to begin its first pass along the next row of labels 18.

Thus, the sheet advancing apparatus of the present invention allows two complete rows of labels to be printed during a single cycle of the die apparatus. Whereas the invention has been shown and described in connection with the preferred embodiment thereof, it will be understood that many modifications, substitutions and additions may be made which are within the intended broad scope of the appended claims. For example, a die 27 may be provided with means for sealing three rows of containers with labels. In such a situation, cylinders 60 and 62 may be provided with longer extensible rods 56 and 58 as well as an additional switch, such that reciprocating cylinder 36 may be extended an additional label length during a single cycle of die 27.

There has therefore been shown and described an improved sheet material advancer which accomplishes at least all of the above-stated objects.

I claim:

1. A method for modifying a conventional packaging apparatus to permit printing on multiple rows of labels during a single cycle, comprising the steps of: providing a packaging apparatus, including;

a frame;

a continuous sheet of labels operably mounted on said frame, said labels forming the transverse rows and longitudinal columns on said continuous sheet, said continuous sheet moving through said packaging apparatus in a direction defined as downstream;

a printer apparatus mounted on said frame adapted to print data on each row of said labels;

a continuous sheet of containers operably mounted on said frame, said containers forming transverse rows and longitudinal columns on said sheet, and passing through said packaging apparatus in a direction defined as downstream;

a die means operably mounted on said frame for sealing together at least two rows of labels and two rows of containers in a single operating cycle;

means for moving said sheets of labels and containers downstream through said packaging apparatus and across said die;

control means connected to said printer apparatus, said die means and said means for moving said sheets, for coordinating the operation thereof in a predetermined manner;

operably mounting a sheet material advancer apparatus on said packaging apparatus upstream of said die means, said sheet material advancer including means for selectively forming variable length strip of said sheet of labels into a loop, operable between a first position, forming a short loop, and a second position, forming an elongated loop; and connecting said loop forming means to said control apparatus for operation coordinated with said die means, printer apparatus and said means for moving said labels and containers through the packaging apparatus.

2. In combination: a packaging apparatus, including:

a frame;

a continuous sheet of labels operably mounted to travel through said frame, said labels forming transverse rows and longitudinal columns on said continuous sheet;

a printer apparatus mounted on said frame adapted to print data on each row of said labels;

a continuous sheet of containers operably mounted to travel through said frame, said containers forming transverse rows and longitudinal columns on said sheet;

a die means operably mounted on said frame for sealing together at least two rows of labels and two rows of containers in a single operating cycle;

means for moving said sheets of labels and containers through said packaging apparatus and across said die in a direction defined as "downstream"; and control means connected to said printer apparatus, said die means and said means for moving said sheets, for coordinating the operation thereof in a predetermined manner; and a sheet material advancer apparatus operably mounted on said packaging apparatus, including:

means for selectively forming a variable length strip of said sheet of labels into a loop, operable between a first position forming a short loop and a second position forming an elongated loop;

said loop forming means being connected to said control apparatus for operation coordinated with said die means, printer apparatus and said means for moving said labels and containers through the packaging apparatus;

said loop forming means including:

a first cylinder means mounted on said packaging apparatus adjacent said label sheet downstream of said printer apparatus;

a reciprocating cylinder means operably mounted on said packaging apparatus parallel to said first cylinder and operable between a "home" position adjacent said first cylinder and an "extended" position spaced a predetermined distance from said first cylinder;

said label sheet moving downstream through said packaging apparatus past said printer apparatus, around a portion of said first cylinder, around said reciprocating cylinder, and thence to said means for moving said continuous sheets; and selectively operably mans for moving said reciprocating cylinder between said "home" and "extended" positions, connected to said control apparatus;

first switch means mounted on said advancer apparatus adjacent said first cylinder, operably between open and closed positions in response to movement of said reciprocating cylinder; and second switch means mounted on said advancer apparats spaced from said first cylinder, operably between ope and closed positions in response to movement of said reciprocating cylinder;

said first and second switch means electrically connected to said control apparatus to produce a signal in response to their open and closed positions.

3. The combination of claim 2, further comprising alignment means connected to said packaging apparatus and associated with said reciprocating cylinder to maintain said reciprocating cylinder parallel to said first cylinder during movement between its "home" and "extended" positions.

* * * * *